US005265816A

United States Patent [19]

Collins

[11] Patent Number: 5,265,816

[45] Date of Patent: Nov. 30, 1993

[54] DOUBLE ROLL TISSUE DISPENSER WITH SLIDING DOOR

[75] Inventor: Scott J. Collins, Brown Deer, Wis.

[73] Assignee: Fort Howard Corporation, Green Bay, Wis.

[21] Appl. No.: 926,478

[22] Filed: Aug. 7, 1992

[51] Int. Cl.[5] ..... B65H 16/02

[52] U.S. Cl. ..... 242/55.3

[58] Field of Search ..... 242/55.3, 55.42; 312/34.19

[56] References Cited

U.S. PATENT DOCUMENTS

| | | | |
|---|---|---|---|
| 3,584,802 | 6/1971 | Sieber | 242/55.3 |
| 3,620,466 | 11/1971 | Bump | 242/55.3 |
| 3,656,699 | 4/1972 | Schuyder et al. | 242/55.3 |
| 3,677,485 | 7/1972 | Berg | 242/55.3 |
| 3,698,653 | 10/1972 | Okamura | 242/55.3 |
| 3,754,719 | 8/1973 | Choy | 242/55.3 |
| 3,770,222 | 11/1973 | Jespersen | 242/55.3 |
| 3,771,739 | 11/1973 | Nelson | 242/55.3 |
| 3,865,295 | 2/1975 | Okamura | 225/47 |
| 3,948,454 | 4/1976 | Bastian | 242/55.3 |
| 4,003,526 | 1/1977 | Fishburn | 252/55.3 |
| 4,034,924 | 7/1977 | Carlisle | 242/55.3 |
| 4,108,389 | 8/1978 | Womack | 242/55.3 |
| 4,113,195 | 9/1978 | Theunissen | 242/55.3 |
| 4,143,827 | 3/1979 | Tucker | 242/55.3 |
| 4,222,621 | 9/1980 | Greenlee et al. | 312/37 |
| 4,260,177 | 4/1981 | Perrin et al. | 242/55.3 |
| 4,362,278 | 12/1982 | Hopkinson | 242/55.3 |
| 4,375,874 | 3/1983 | Leotta et al. | 242/55.3 |
| 4,389,026 | 6/1983 | Willa et al. | 242/55.3 |
| 4,407,459 | 10/1983 | Wormly | 242/55.53 |
| 4,422,584 | 12/1983 | Dashnier et al. | 242/55.3 |
| 4,422,585 | 12/1983 | Schultz et al. | 242/55.53 |
| 4,520,968 | 6/1985 | Shpigelman | 242/55.3 |
| 4,564,148 | 1/1986 | Wentworth | 242/55.3 |
| 4,662,577 | 5/1987 | Lewis | 242/55.3 |
| 4,697,754 | 10/1987 | Duff | 242/55.3 |
| 4,773,608 | 9/1988 | Quackenbush | 242/55.3 |
| 4,807,823 | 2/1989 | Wyant | 242/55.3 |
| 4,828,343 | 5/1989 | Murano | 312/38 |
| 4,844,361 | 7/1989 | Granger | 242/55.3 |
| 4,872,601 | 10/1989 | Sigmund | 242/55.3 |
| 4,944,466 | 7/1990 | Jespersen | 242/55.3 |
| 4,998,681 | 3/1991 | McNeill | 242/55.53 |

FOREIGN PATENT DOCUMENTS 1330650 9/1973 United Kingdom .

*Primary Examiner*—Daniel P. Stodola
*Assistant Examiner*—Eileen Dunn
*Attorney, Agent, or Firm*—Michael, Best & Friedrich

[57] ABSTRACT

A two roll dispenser for toilet tissue or similar sheet material which is arranged so that replacement of an empty core on either roll support with a new roll insures that a user cannot change to the dispensing position for the new roll until the other roll has been used up.

6 Claims, 4 Drawing Sheets

DOUBLE ROLL TISSUE DISPENSER WITH SLIDING DOOR

BACKGROUND OF THE INVENTION

The invention relates to dispensers and, more particularly, to dispensers for two rolls of toilet tissue and similar rolls of sheet material.

One type toilet tissue dispenser for public restrooms and the like is arranged to dispense two rolls of tissue. Such dispensers typically include some sort of mechanism for limiting access by users to only one roll at a time.

One known double roll toilet tissue dispenser has a housing including a base having a pair of supports for rotatably supporting two rolls of toilet tissue side by side and a cover hinged to the base and cooperating therewith to define a storage compartment for both rolls. The dispenser housing has an elongated opening through which a user can gain access to both rolls of toilet tissue. A slider partially covers the opening and is movable between a first dispensing position to permit access to a first roll while blocking access to the second roll and a second dispensing position to permit access to the second roll and block access to the first roll. An arm carried by the slider is arranged to clear an empty roll core but engages tissue on a full or partially full roll to prevent the slider from being moved to the second dispensing position until all or substantially all the tissue on the first roll has been used. Thus, a user cannot gain access to the second roll until the first roll is empty.

The slider is spring biased toward the first dispensing position and, after being moved to the second dispensing position, is releasably held in that position by a detent on the cover. The detent is released when the cover is opened to replace rolls and the spring returns the slider to the first dispensing position.

Starting with two full rolls during normal use, the slider is biased to the first position by the spring and users can use tissue from the first roll but not the second. Upon finding the first roll empty, a user slides the slider to the second dispensing position and starts using tissue from the second roll. As part of routine maintenance, attendants typically are instructed to remove the empty core for the first roll, replace it with the partially used second roll and install a new roll in place of the partially used second one. The slider is returned by the spring to the first dispensing position when the cover is opened, so the above cycle is repeated after the cover is closed.

It is not uncommon for an attendant to merely replace the empty core of the first roll with a new roll, rather than removing the empty core for the first roll, replace it with the partially used second roll and install a new roll in place of the partially used second one. When this neglect occurs, the second roll often is partially used when a user moves the slider to the second dispensing position. Consequently, an attendant inspecting a dispenser and finding it still in the first dispensing position may underestimate how long it will take for the second roll to be used up. Also, if both rolls are partially used when a maintenance person opens the cover for inspection, there may be tendency to discard both rolls and replace them with new ones.

SUMMARY OF THE INVENTION

An object of the invention is to provide a two roll dispenser for toilet tissue or similar sheet material which is arranged so that replacement of an empty core on either roll support with a new roll insures that a user cannot change to the dispensing position for the new roll until the other roll has been used up.

Another object of the invention is to provide such a dispenser having a simple construction and highly reliable operation.

Other objects, aspects and features of the invention will become apparent to those skilled in the art upon reviewing the following detailed description, the drawings and the appended claims.

DETAILED DESCRIPTION OF THE PREFERRED EMBODIMENT OF THE INVENTION

Figure 4:
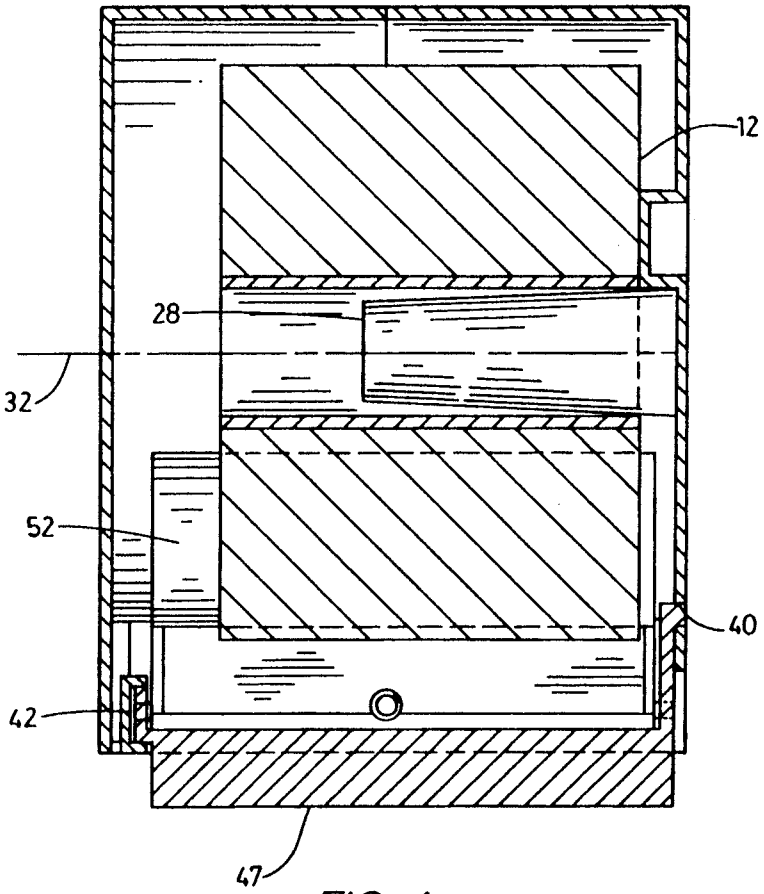
FIG. 4 is a sectional view taken along line 4—4 in FIG. 1.

Illustrated in the drawings is a double roll dispenser 10 for dispensing first and second (or right and left) rolls 14 and 12, respectively, of sheet material 16, such as toilet tissue, wrapped around respective cores 18 and 20.

Figure 1:
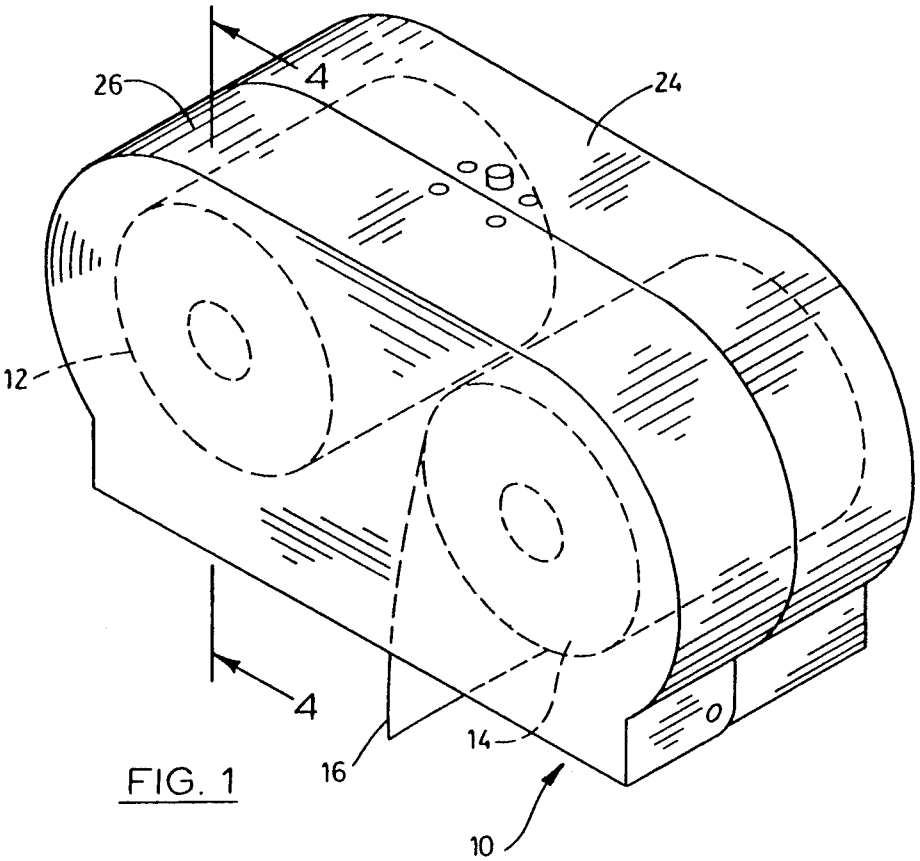
FIG. 1 is a perspective view of a tissue dispenser embodying various of the features of the invention and showing a cover of the dispenser in a closed position.
Figure 2:
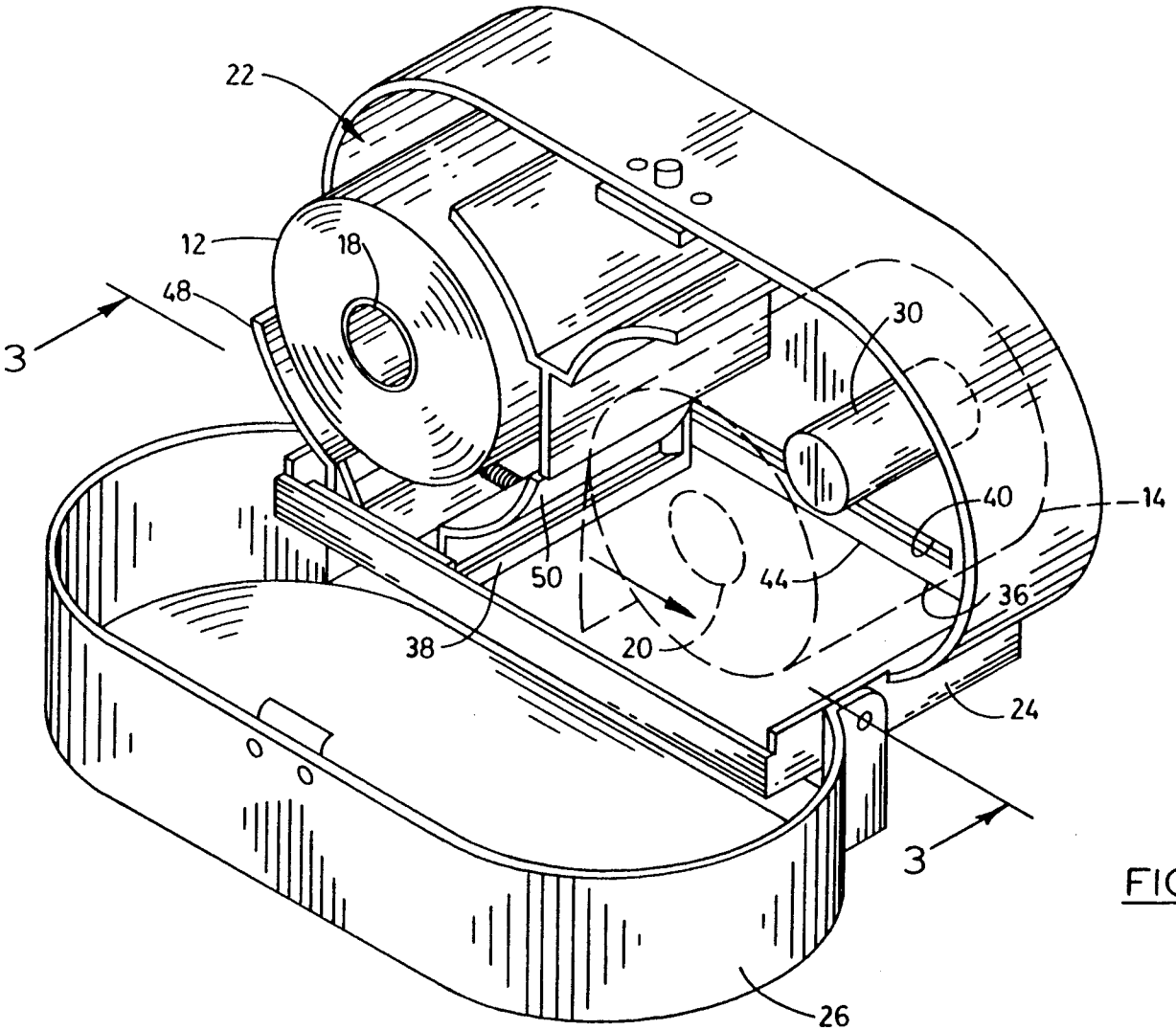
FIG. 2 is a perspective view of a tissue dispenser of FIG. 1 with the cover in an open position.

The dispenser 10 includes a housing 22 including a base member 24 and a cover 26 hinged or otherwise suitably pivotally mounted to the base member 24 for movement between an open position shown in FIG. 2 and a closed position shown in FIG. 1. When the cover 26 is in the closed position, it cooperates with the base member 24 to define a storage compartment for the rolls 12 and 14.

The dispenser 10 includes roll core support members 28 and 30 disposed inside the storage compartment for respectively receiving the cores 18 and 20 of and supporting the left and right rolls 12 and 14 side by side for rotation about respective parallel-spaced axes 32 and 34. As best shown in FIG. 2, the base member 24 has an elongated, generally rectangular opening 36 through which a user can gain access to either the left roll 12 or the right roll 14 depending on the position of a blocking means which is included in the dispenser 10 and which is for selectively closing a portion of the opening 36.

Figure 5:
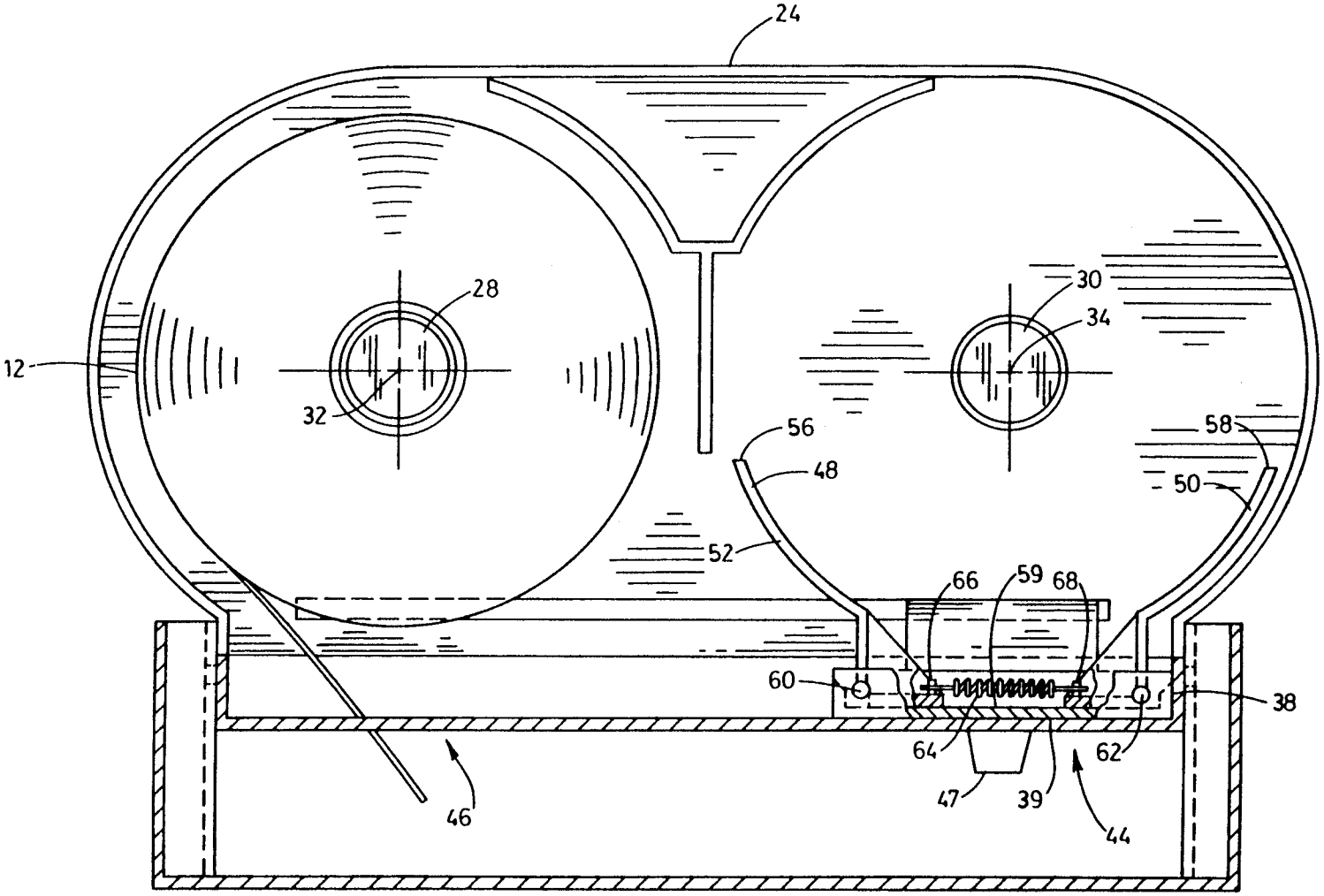
FIG. 5 is similar to FIG. 3 but shows a blocking means of the dispenser in a different position than that illustrated in FIG. 3.

The blocking means includes a slider 38 slidably mounted in opposed grooves (the word "groove" as used herein being intended to encompass slots or channels) 40 and 42 in the base member 24 for movement between a first or left dispensing position (shown in FIG. 2) and a second or right dispensing position (shown in FIG. 5). When the slider 38 is in the left dispensing position (FIG. 2), a first or right portion 44 of the opening 36 is uncovered to permit access to the first or right roll 14, and a second or left portion 46 of the opening 36 is closed to prevent access to the second or left roll 12. When the slider 38 is in the right dispensing position (FIG. 5), the right portion 44 of the opening 36 is covered to prevent access to the right roll 14 and the left portion 46 of the opening 36 is uncovered to permit access to the left roll 12.

Figure 3:
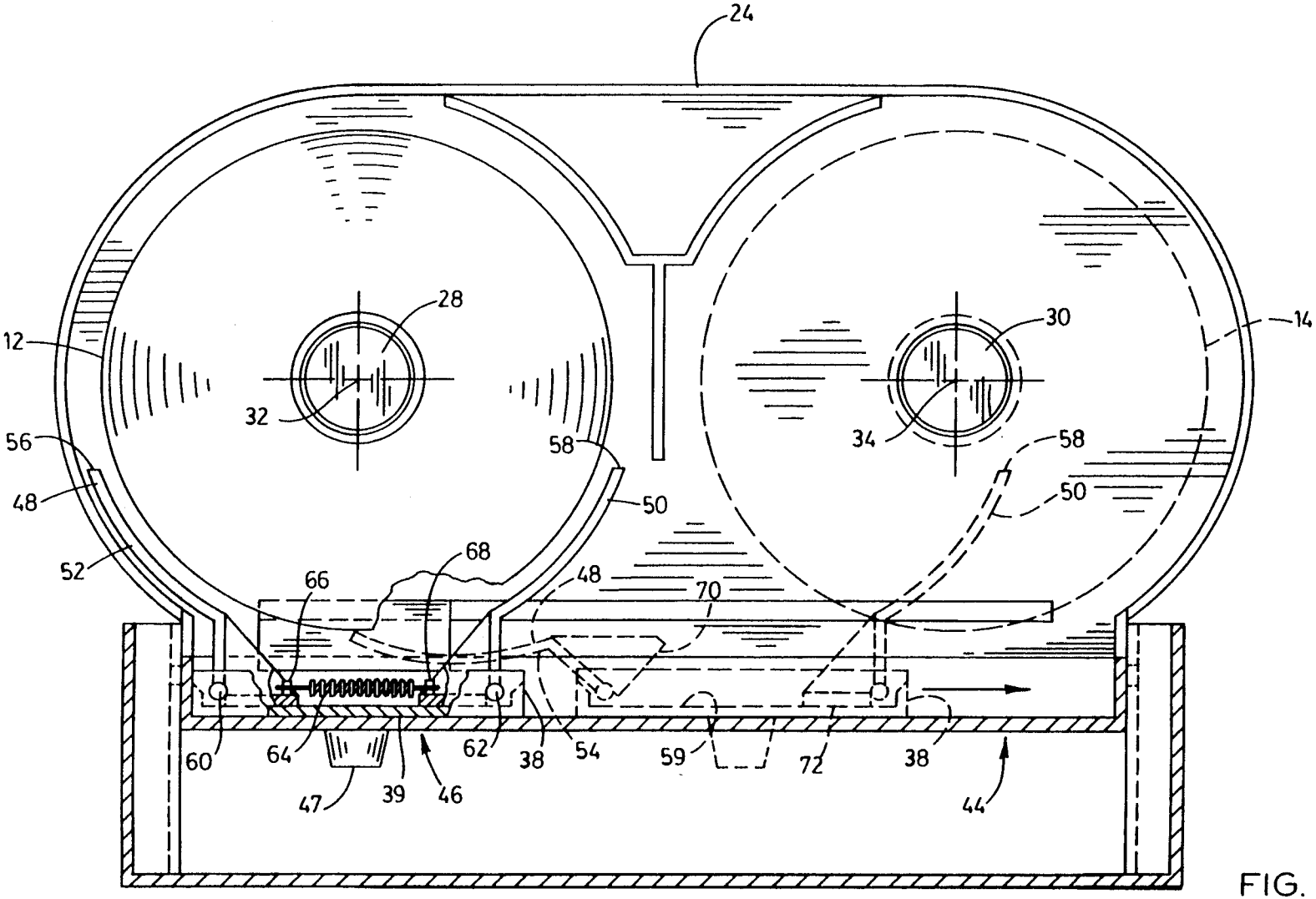
FIG. 3 is a sectional view taken along line 3—3 in FIG. 2.

The slider 38 is manually moved from one dispensing position to the other by the user. The slider 38 has an outer surface 39 (see FIG. 3) facing away from the housing and a handle 47 integrally formed with the slider and extending outwardly from the outer surface 39 of the slider 38 for that purpose.

The dispenser 10 further includes detent means carried by the slider 38 for preventing movement of the slider 38 from the left dispensing position (FIG. 2) to the right dispensing position (FIG. 5) until substantially all the toilet tissue has been unrolled from the right roll 14 and for preventing movement of the slider 38 from the right dispensing position (FIG. 5) to the left dispensing position (FIG. 2) until substantially all the toilet tissue has been rolled from the left roll 12. In the illustrated embodiment, the detent means includes a pair of opposed arms 48 and 50, respectively, arranged to partially envelope a full roll of material, and means mounting each of the arms 48 and 50 on the slider 38 for pivotal movement in a direction toward and away from the rotational axes 32 and 34 of the rolls 12 and 14 between a raised or blocking position 52 adjacent the outer surface of a full roll and a lowered or non-blocking position 54 wherein the arm can be moved over a fully or partially full roll (see FIG. 3) while the other arm is in the raised or blocking position 52. The arms 48 and 50 have respective outer (or upper) edges 56 and 58 corresponding to a predetermined diameter of a roll on a support members when the arms are in the blocking position. The arms 48 and 50 are pivotally mounted to the slider 38 by pivot pins 60 and 62 that define the mounting means (see FIG. 3). More particularly, the slider 38 has an inner surface 59 facing the interior of the housing, and the arms 48 and 50 are pivotally connected to the slider 38 at respective locations spaced from the inner surface 59 in a direction toward the rotational axes by the respective pivot pins 60 and 62.

The dispenser 10 further includes means for biasing both of the arms 48 and 50 toward the raised position. In the illustrated embodiment, the biasing means includes a spring 64 connected to the arm 48 and to the arm 50 at respective portions 66 and 68 of the arms 48 and 50 above the pivot pins 60 and 62.

The arms 48 and 50 have respective surfaces 70 and 72 (see FIG. 3) that engage the inner surface 59 of the slider when the arm is in the raised position so as to limit pivotal movement of the arm in the direction toward the rotational axes 32 and 34.

In use, movement of the blocking means from one of the dispensing positions toward the other dispensing position is prevented, when the outside diameter of the material remaining on the core of the roll accessible through the opening 36 is greater than the predetermined diameter, because the arm closest to the accessible roll remains in the blocking position and the outer edge portion thereof engages the material on the accessible roll. Such movement is permitted when substantially all the material has been unrolled from the accessible roll and the outside diameter of the core of the accessible roll is less than the predetermined diameter because the outer edge of the arm closest to the accessible roll clears the core of the accessible roll and the other arm is cammed to the non-blocking position by material on the other roll.

In the illustrated embodiment, the first support member is not movable relative to the second support member. Also, in the illustrated embodiment, the cover is comprised of translucent material so that a maintenance person can easily judge how much material remains on the rolls. The dispenser 10 optionally but preferably includes a lock for selectively locking the cover to the base member 24.

While a preferred embodiment of the invention has been described, various modifications are possible. Thus, the scope of the invention is to be limited only by the scope and spirit of the following claims. It is to be understood that while the invention may be described, in the following claims, in a certain orientation, this is only to simplify description of the relative orientation of one component of a claim with another component of the same claim, and the entirety of the structure claimed in that claim could be oriented in a different manner while still falling within the intended spirit and scope of the claim.

I claim:

1. A dispenser for two rolls of sheet material wrapped around respective cores, said dispenser comprising:

a housing including a base member and a cover mounted on said base member such that said cover is movable relative to said base member between open and closed positions, said cover, when in the closed position, cooperating with said base member to define a storage compartment for said rolls;

a pair of roll core support members disposed inside said storage compartment for receiving the cores of and supporting said first and second rolls side by side for rotation about respective parallel-spaced axes, said base member having an opening through which a user can gain access to both said first and second rolls;

a blocking means for selectively closing a portion of said opening, said blocking means being mounted to said housing such that said blocking means is movable between a first dispensing position wherein a first portion of said opening is uncovered to permit access to said first roll and a second portion of said opening is closed to prevent access to said second roll and a second dispensing position wherein said first portion of said opening is covered to prevent access to said first roll and said second portion of said opening is uncovered to permit access to said second roll; and detent means carried by said blocking means for preventing movement of said blocking means from said first dispensing position to said second dispensing position until substantially all the material has been unrolled from said first roll and for preventing movement of said blocking means from said second dispensing position to said first dispensing position until substantially all the material has been rolled from said second roll, said detent means including a pair of opposed arms arranged to partially envelope a full roll of material, means mounting each of said arms for pivotal movement in a direction toward and away from the rotational axes of said first and second rolls between a blocking position adjacent the outer surface of a full roll and a non-blocking position wherein said arm can be moved over a full or partially full roll, each of said arms having an outer edge corresponding to a predetermined diameter of a roll on a said support member when said arm is in the blocking position, and means for biasing both of said arms toward the respective blocking positions;

whereby movement of said blocking means from one of said dispensing positions toward the other is prevented, when the outside diameter of the material remaining on the core of the roll accessible through said opening is greater than said predetermined diameter, because said arm closest to the accessible roll remains in the blocking position and the outer edge portion thereof engages the material on the accessible roll, and such movement is permitted, when substantially all the material has been unrolled from the accessible roll and the outside diameter of the core is less than said predetermined diameter because the outer edge of said arm closest to the accessible roll clears the core of the accessible roll and the other said arm is cammed to a non-blocking position by material on the other roll.

2. A dispenser in accordance with claim 1 wherein the first support member fixed against movement relative to the second support member.

3. A dispenser in accordance with claim 1 wherein said base member has defined therein opposed slots adjacent said opening, wherein said blocking means comprises a slider mounted in the opposed slots for movement between the first dispensing position and the second dispensing position.

4. A dispenser in accordance with claim 3 wherein said slider has an inner surface facing into said housing, wherein at least one of said arms is pivotally connected to said slider at a location spaced from said inner surface in a direction toward said rotational axes, and wherein said one arm has a surface that engages said inner surface of said slider when said one arm is in the blocking position so as to limit pivotal movement of said one arm in the direction toward said rotational axes.

5. A dispenser in accordance with claim 4 wherein each of said arms includes a spring engaging portion spaced from said pivot pins in a direction toward said rotational axes, and wherein said biasing means includes a spring connected between said arms at the respective spring engaging portions.

6. A dispenser in accordance with claim 3 wherein said slider has an outer surface facing away from said housing, and wherein said dispenser further includes a handle, integral with said slider, and on said outer surface of said slider.

* * * * *